US008725032B2

(12) United States Patent
Sato et al.

(10) Patent No.: US 8,725,032 B2
(45) Date of Patent: May 13, 2014

(54) IMAGE FORMING APPARATUS

(75) Inventors: Shougo Sato, Seto (JP); Hiroshi Nakano, Nagoya (JP); Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 51 days.

(21) Appl. No.: 13/349,685

(22) Filed: Jan. 13, 2012

(65) Prior Publication Data

US 2012/0183322 A1 Jul. 19, 2012

(30) Foreign Application Priority Data

Jan. 14, 2011 (JP) ..... 2011-005945

(51) Int. Cl.
*G03G 15/00* (2006.01)

(52) U.S. Cl.
USPC ..... 399/110; 399/117

(58) Field of Classification Search
USPC ..... 399/117
See application file for complete search history.

(56) References Cited

U.S. PATENT DOCUMENTS

| | | | | |
|---|---|---|---|---|
| 5,008,489 | A * | 4/1991 | Weeks et al. | 174/36 |
| 7,843,483 | B2 | 11/2010 | Yokoi et al. | |
| 8,111,277 | B2 | 2/2012 | Yokoi et al. | |
| 8,265,520 | B2 | 9/2012 | Irie et al. | |
| 2003/0053819 | A1 | 3/2003 | Nomura et al. | |
| 2006/0067734 | A1 | 3/2006 | Igarashi et al. | |
| 2008/0219696 | A1 | 9/2008 | Itabashi | |
| 2008/0226347 | A1* | 9/2008 | Nagai | 399/177 |
| 2009/0092412 | A1* | 4/2009 | Kei | 399/110 |
| 2009/0142092 | A1* | 6/2009 | Sato | 399/111 |
| 2009/0169228 | A1 | 7/2009 | Yokoi et al. | |
| 2009/0190953 | A1 | 7/2009 | Okabe | |
| 2009/0269101 | A1 | 10/2009 | Okabe et al. | |
| 2010/0329728 | A1* | 12/2010 | Irie et al. | 399/110 |
| 2011/0037823 | A1 | 2/2011 | Yokoi et al. | |
| 2012/0189346 | A1 | 7/2012 | Okabe et al. | |
| 2014/0044452 | A1 | 2/2014 | Okabe et al. | |

FOREIGN PATENT DOCUMENTS

| | | |
|---|---|---|
| JP | 08-036346 | 2/1996 |
| JP | 2000-012166 A | 1/2000 |
| JP | 2003-043776 | 2/2003 |
| JP | 2006-098772 | 4/2006 |
| JP | 2006-248119 A | 9/2006 |
| JP | 2007-065125 A | 3/2007 |

(Continued)

OTHER PUBLICATIONS

Notification of Reasons for Refusal mailed Jan. 21, 2014, JP Appln. 2011-005945, English translation.

*Primary Examiner* — Clayton E LaBalle
*Assistant Examiner* — Jas Sanghera
(74) *Attorney, Agent, or Firm* — Banner & Witcoff, Ltd.

(57) ABSTRACT

An image forming apparatus includes: a plurality of photoconductor drums; a plurality of exposure members; a drum supporting member having a pair of side walls disposed opposite to each other in an axial direction of the photoconductor drum and configured to support the photoconductor drums and the exposure members between the side walls; a belt disposed below and opposite to the photoconductor drums; a pair of guide members configured to support the drum supporting member while allowing rectilinear movement of the drum supporting member; and a main body circuit board provided in the main body and connected to the exposure members via a cable. The main body circuit board is arranged above the drum supporting member.

18 Claims, 8 Drawing Sheets

(56) References Cited

FOREIGN PATENT DOCUMENTS

| | | | |
|---|---|---|---|
| JP | 2008-221587 | A | 9/2008 |
| JP | 2008-224837 | | 9/2008 |
| JP | 2009-139495 | | 6/2009 |
| JP | 2009-157135 | | 7/2009 |
| JP | 2009157138 | A | 7/2009 |
| JP | 2009-175416 | | 8/2009 |
| JP | 2009-265442 | A | 11/2009 |
| JP | 2010-054814 | A | 3/2010 |
| JP | 2011-008077 | A | 1/2011 |

* cited by examiner

IMAGE FORMING APPARATUS

CROSS-REFERENCE TO RELATED APPLICATION(S)

This application claims priority from Japanese Patent Application No. 2011-005945 filed on Jan. 14, 2011, the disclosure of which is incorporated herein by reference in its entirety.

TECHNICAL FIELD

The present invention relates to an image forming apparatus with a drum supporting member configured to support a plurality of photoconductor drums and exposure members.

BACKGROUND ART

There is known an image forming apparatus which includes a plurality of photoconductor drums, a plurality of LED heads (exposure members) configured to expose the plurality of photoconductor drums to light, a drum supporting member configured to support the photoconductor drums and the LED heads and allowed to be pulled out from a main body of the image forming apparatus, and a control circuit board provided in the main body and connected to the LED heads via a cable. According to this image forming apparatus, the photoconductor drums are supported at an upper part of the drum supporting member and the LED heads are supported by the drum supporting member at positions lower than the photoconductor drums.

Further, an intermediate transfer belt is arranged over and in contact with the photoconductor drums, and the control circuit board is disposed below the drum supporting member. Namely, the intermediate transfer belt, the drum supporting member, and the control circuit board are arranged in this order from the upper side of the image forming apparatus, and the LED heads supported by the drum supporting member are connected to the control circuit board via the cable.

SUMMARY OF THE INVENTION

The inventors of the present invention attempt to change the arrangement of the above image forming apparatus and to develop a structure in which an intermediate transfer belt is disposed below the drum supporting member. However, according to this structure, the intermediate transfer belt is arranged below the drum supporting member, with the result that the cable extending downward from the drum supporting member may disadvantageously interfere with the intermediate transfer belt.

In view of the above, it would be desirable to provide an image forming apparatus which can avoid interference between the belt and the cable.

According to the present invention, an image forming apparatus comprises: a plurality of photoconductor drums; a plurality of exposure members each configured to expose a corresponding photoconductor drum to light to form an electrostatic latent image on the photoconductor drum; a drum supporting member having a pair of side walls disposed opposite to each other in an axial direction of the photoconductor drum and configured to support the plurality of photoconductor drums and the plurality of exposure members between the side walls; a belt disposed below and opposite to the photoconductor drums; a pair of guide members configured to support the drum supporting member while allowing rectilinear movement of the drum supporting member between a retracted position in which the drum supporting member is received in a main body of the image forming apparatus and a pull-out position to which the drum supporting member is moved from the retracted position and pulled out from the main body through an opening formed in the main body; and a main body circuit board provided in the main body and connected to the plurality of exposure members via a cable. In this image forming apparatus, the main body circuit board is arranged above the drum supporting member.

BRIEF DESCRIPTION OF THE DRAWINGS

To better understand the claimed invention, and to show how the same may be carried into effect, reference will now be made, by way of example only, to the accompanying drawings, in which:

DESCRIPTION OF EMBODIMENT

Figure 1:
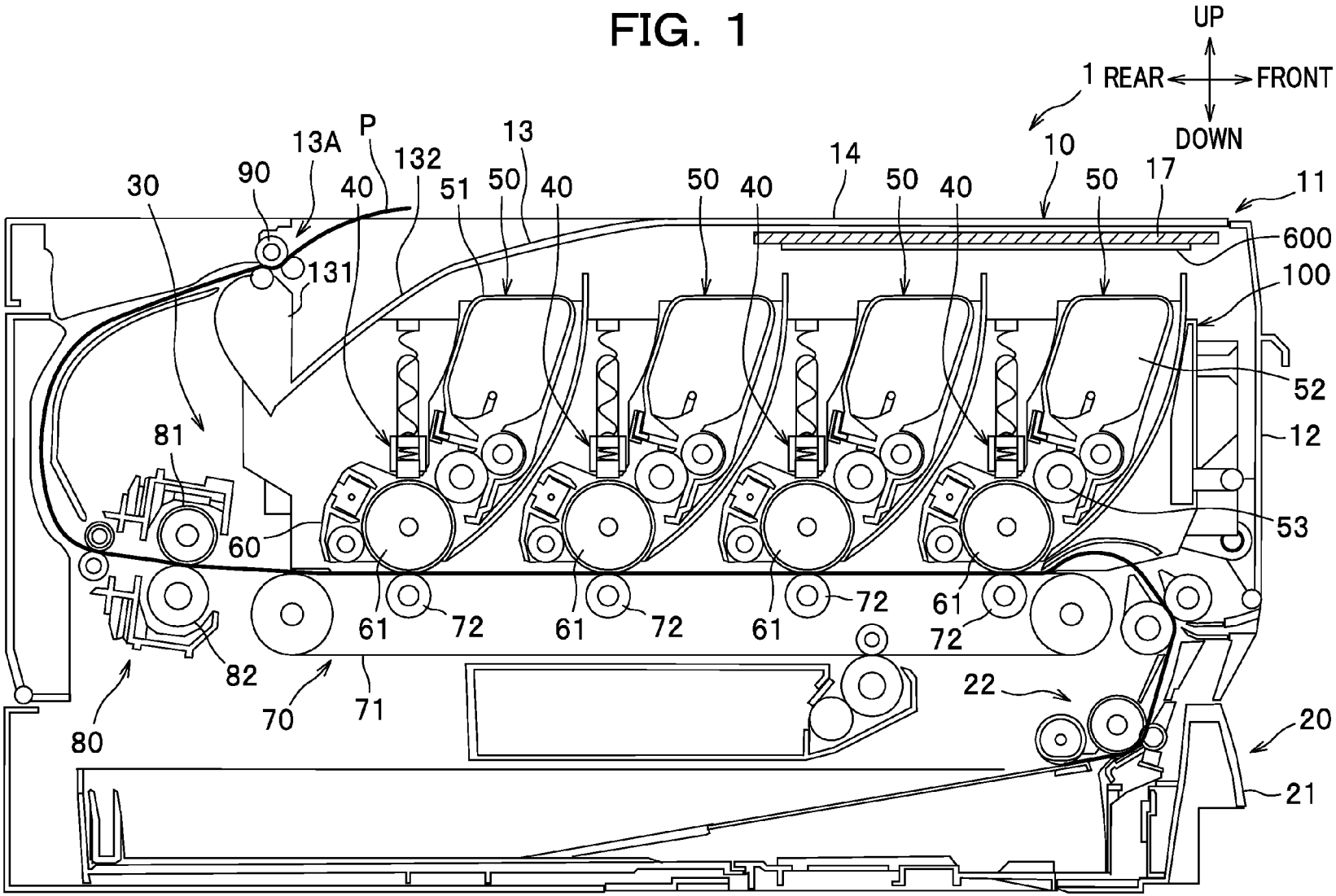
FIG. 1 is a schematic sectional view of a color printer according to one exemplary embodiment of the present invention.

A detailed description will be given of an illustrative embodiment of the present invention with reference to the accompanying drawings. In the following description, a general arrangement of a color printer as an example of an image forming apparatus will be described, and thereafter characteristic features of the present invention will be described in detail.

In the following description, the direction is designated as from the viewpoint of a user who is using (operating) the color printer. To be more specific, in FIG. 1, the right-hand side of the drawing sheet corresponds to the "front" side of the color printer, the left-hand side of the drawing sheet corresponds to the "rear" side of the color printer, the front side of the drawing sheet corresponds to the "left" side of the color printer, and the back side of the drawing sheet corresponds to the "right" side of the color printer. Similarly, the direction extending from top to bottom of the drawing sheet corresponds to the "vertical" or "upward-and-downward (up/down, upper/lower or top/bottom)" direction of the color printer. For ease of reference, hatching is used in sectional views only where it seems necessary.

As seen in FIG. 1, a color printer 1 includes a main body casing 10 as an example of a main body, and several components housed within the main body casing 10 which include a sheet feeder unit 20 for feeding a sheet of paper P (hereinafter simply referred to as a "sheet" P) as an example of a recording sheet, and an image forming unit 30 for forming images corresponding to four colors of black (K), cyan (C), magenta (M), and yellow (Y) on the supplied sheet P to stack these colors one on top of another.

The main body casing 10 has a front wall, and an opening 11 (see FIG. 3) is formed in the front wall (front side of the main body casing 10). A front cover 12 is pivotally supported on the main body casing 10 to open and close the opening 11. To be more specific, the front cover 12 is swingable (movable) between a closed position (i.e., position shown in FIG. 1) in which the opening 11 is closed by the cover 12 and an opened position (i.e., position shown in FIG. 3) in which the opening 11 is left open.

The sheet feeder unit 20 includes a sheet feed tray 21 for storing sheets P, and a sheet conveyance device 22 for conveying a sheet P from the sheet feed tray 21 to the image forming unit 30.

The image forming unit 30 includes four LED arrays 40 as an example of a plurality of exposure members, four process cartridges 50, a transfer unit 70, and a fixing unit 80.

Each LED array 40 comprises a plurality of LEDs fabricated on a semiconductor chip, and is configured to expose a photoconductor drum 61 to be described later to light along a main scanning direction, that is an axial direction of the photoconductor drum 61. Four LED arrays 40 corresponding to respective colors are supported by a drawer 100 as an example of a drum supporting member to be described later and positioned adjacent to and at positions higher than four photoconductor drums 61 provided corresponding to the respective colors.

The process cartridges 50 are arranged in tandem in the front-and-rear direction. Each process cartridge 50 comprises a development cartridge 51, and a drum cartridge 60 disposed under the development cartridge 51. The process cartridges 50 are detachably mounted to the drawer 100.

The development cartridge 51 includes a toner receptacle 52 for storing toner as an example of developer, a development roller 53 for supplying toner stored in the toner receptacle 52 to the photoconductor drum 61, and other components such as a supply roller (reference numeral omitted) and a doctor blade (reference numeral omitted). The four development cartridges 51 store different colors of toner corresponding to the four photoconductor drums 61. The four development cartridges 51 are disposed adjacent to the corresponding photoconductor drums 61 at diagonally upward and frontward positions, and detachably mounted to the corresponding drum cartridges 60.

The drum cartridge 60 includes a photoconductor drum 61, and other components such as a known charger (reference numeral omitted). The four drum cartridges 60 are detachably mounted to the drawer 100 to be described later.

The transfer unit 70 is arranged between the sheet feeder unit 20 and the photoconductor drums 61. The transfer unit 70 includes an endless conveyor belt 71 looped around a plurality of rollers, and four transfer rollers 72. The conveyor belt 71 is disposed below and opposite to the plurality of photoconductor drums 61. The transfer rollers 72 are disposed inside the conveyor belt 71 such that the conveyor belt 71 is nipped between the photoconductor drums 61 and the transfer rollers 72.

The fixing unit 80 is arranged at the rear of the process cartridges 50 and the transfer unit 70. The fixing unit 80 includes a heating roller 81, and a pressure roller 82 positioned opposite to the heating roller 81 and pressed against the heating roller 81.

According to the image forming unit 30 configured as described above, the surface of each photoconductor drum 61 is uniformly charged by the charger, and then exposed to light by the LED array 40. Accordingly, the electric potential of the exposed area lowers and an electrostatic latent image associated with image data is formed on the surface of each photoconductor drum 61. Thereafter, toner is supplied from the development roller 53 onto the electrostatic latent image, so that a toner image is carried on the photoconductor drum 61.

Toner images formed on the plurality of photoconductor drums 61 are transferred onto a sheet P while the sheet P is conveyed on the conveyor belt 71 and passes between the photoconductor drums 61 and the transfer rollers 72. When the sheet P passes between the heating roller 81 and the pressure roller 82, the toner images transferred onto the sheet P are thermally fixed.

The sheet P with the toner images thermally fixed thereon by the fixing unit 80 is ejected out from the main body casing 10 by sheet output rollers 90 disposed downstream from the fixing unit 80 in a sheet conveyance direction along which the sheet P is conveyed. The sheet P thus ejected is accumulated on a sheet output tray portion 13 formed on an upper wall 14 of the main body casing 10. The upper wall 14 of the main body casing 10 is recessed at the center part in the right-and-left direction to form the sheet output tray portion 13, so that a space is formed in the main body casing 10 at each side of the sheet output tray portion 13 (i.e., at each side of the photoconductor drums 61 in their axial direction).

To be more specific, the sheet output tray portion 13 includes a first wall 131 extending perpendicularly downward from the upper wall 14 of the main body casing 10 and having an ejection opening 13A for ejecting sheets P, and a second wall 132 extending diagonally upward and frontward from the lower end of the first wall 131 toward the upper wall 14 and having an upwardly projecting arcuate cross-section.

Structure of Drawer 100 and Therearound

Next, a structure around the drawer 100 will be described in detail.

Figure 2:
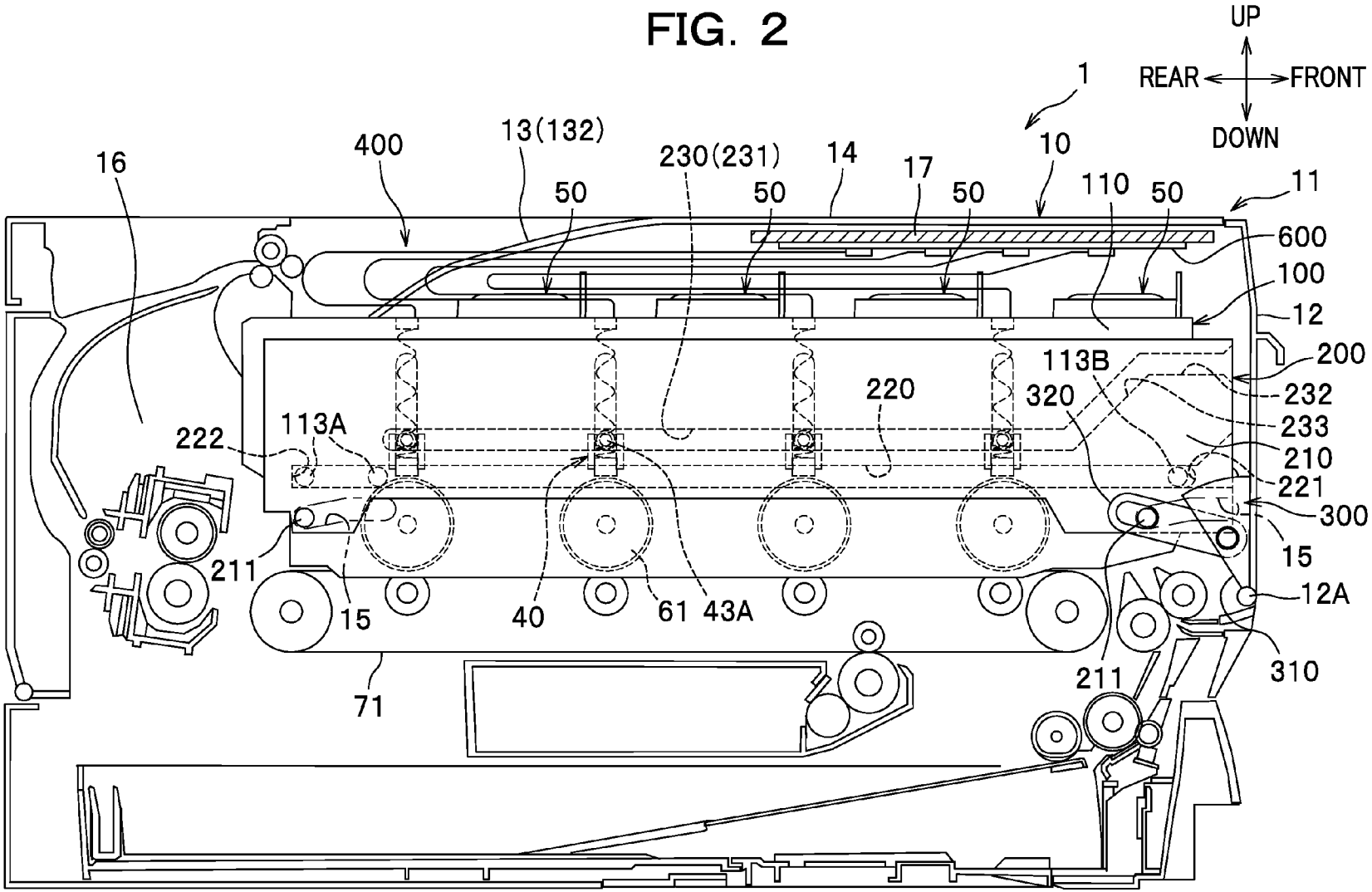
FIG. 2 is a sectional view showing positions of a drawer and a guide member when the front cover is in a closed position.
Figure 3:
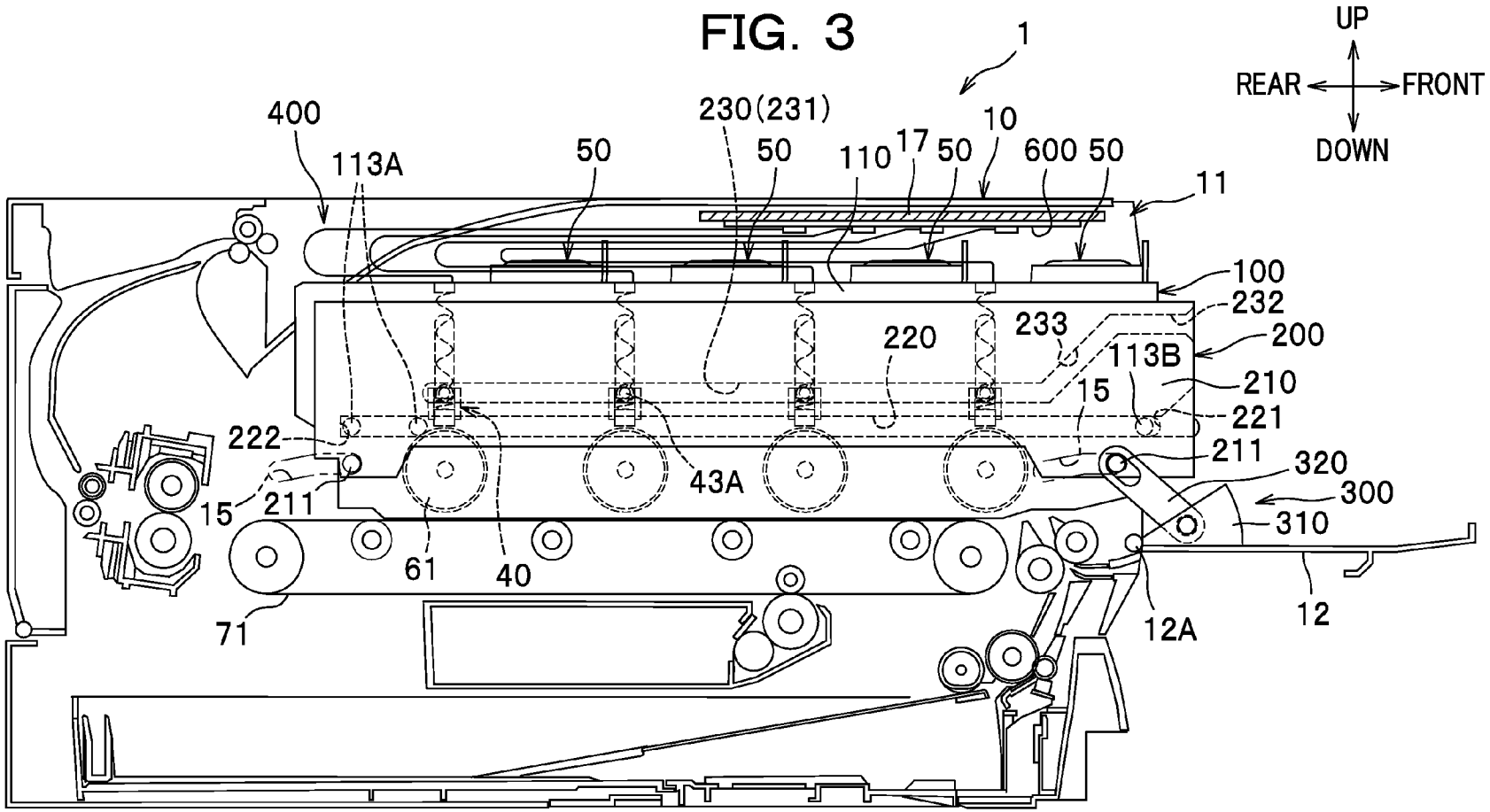
FIG. 3 is a sectional view showing the positions of the drawer and the guide member when the front cover is in an opened position.
Figure 4:
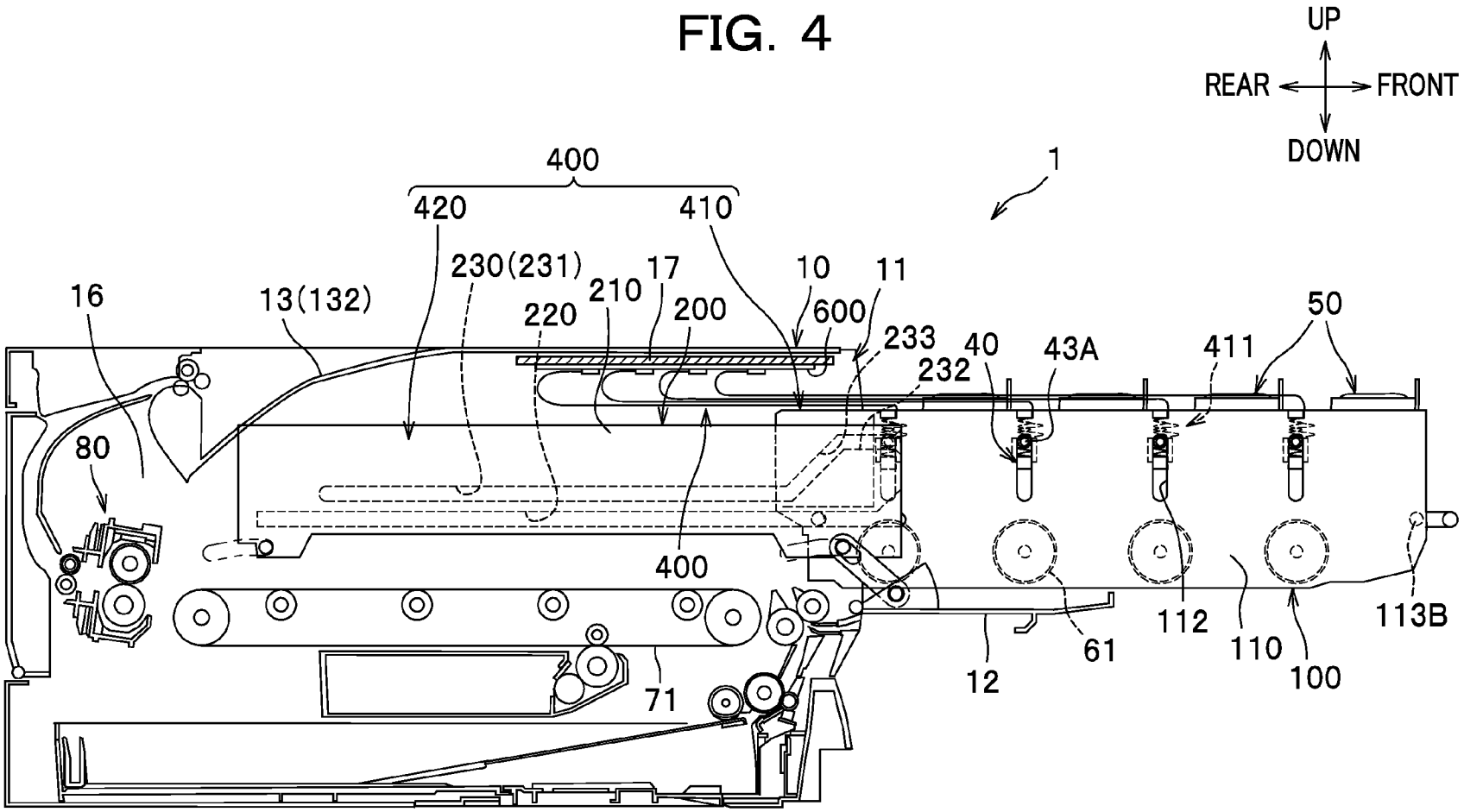
FIG. 4 is a sectional view showing a state in which the drawer has been pulled out from the main body casing.

As best seen in FIGS. 2 to 4, the drawer 100 is configured to be movable in the front-and-rear direction between a retracted position (i.e., position shown in FIG. 3) in which the drawer 100 is received in the main body casing 10 and a pull-out position (i.e., position shown in FIG. 4) in which the drawer 100 has been moved from the retracted position through the opening 11 formed in the main body casing 10 outside the main body casing 10. Namely, the drawer 100 is allowed to be pulled out forward in a sheet output direction along which the sheet P is discharged with respect to the sheet output tray portion 13.

To be more specific, opening the front cover 12 causes the drawer 100 to be moved upward, and from this lifted-up position, the drawer 100 can be pulled out forward through the opening 11. In other words, the drawer 100 is movable in the upward-and-downward direction (i.e., optical axis direction of the LED arrays 40) as well as in the front-and-rear direction (i.e., direction along which the plurality of photoconductor drums 61 are arranged).

The LED arrays 40 disposed in the drawer 100 are moved upward and downward in accordance with forward and rearward movements of the drawer 100. To be more specific, when the drawer 100 is positioned in the retracted position, the plurality of LED arrays 40 are positioned in an exposure position (i.e., position shown in FIG. 3) in which the LED arrays 40 are positioned adjacent to the photoconductor drums 61, and when the drawer 100 is positioned in the pull-out position, the LED arrays 40 are positioned in a retreating position (i.e., position shown in FIG. 4) in which the LED arrays 40 are away from the photoconductor drums 61 and engaged with stopper portions (e.g., upper ends of oblong holes 112 to be described later).

The LED arrays 40 are located in the drawer 100 when they are in the exposure position and in the retreating position. Namely, the LED arrays 40 are configured not to protrude beyond the drawer 100 when they are in the exposure position as well as in the retreating position. Accordingly, the plurality of LED arrays 40 can be protected from the user and other parts.

To be more specific, the main body casing 10 includes the drawer 100, a pair of right and left guide members 200 configured to support the drawer 100 while allowing rectilinear movement of the drawer 100 in the front-and-rear (horizontal) direction, and a pair of right and left interlocking mechanisms 300 configured to cause the pair of guide members 200 to move diagonally upward and frontward or to move diagonally downward and rearward in synchronization with the opening and closing operation of the front cover 12.

Since parts such as the guide members 200 and the interlocking mechanisms 300 are arranged at right and left sides and each having a symmetrical configuration, only one of the parts will be described in the following description and description to the other of the parts will be omitted.

Figure 5:
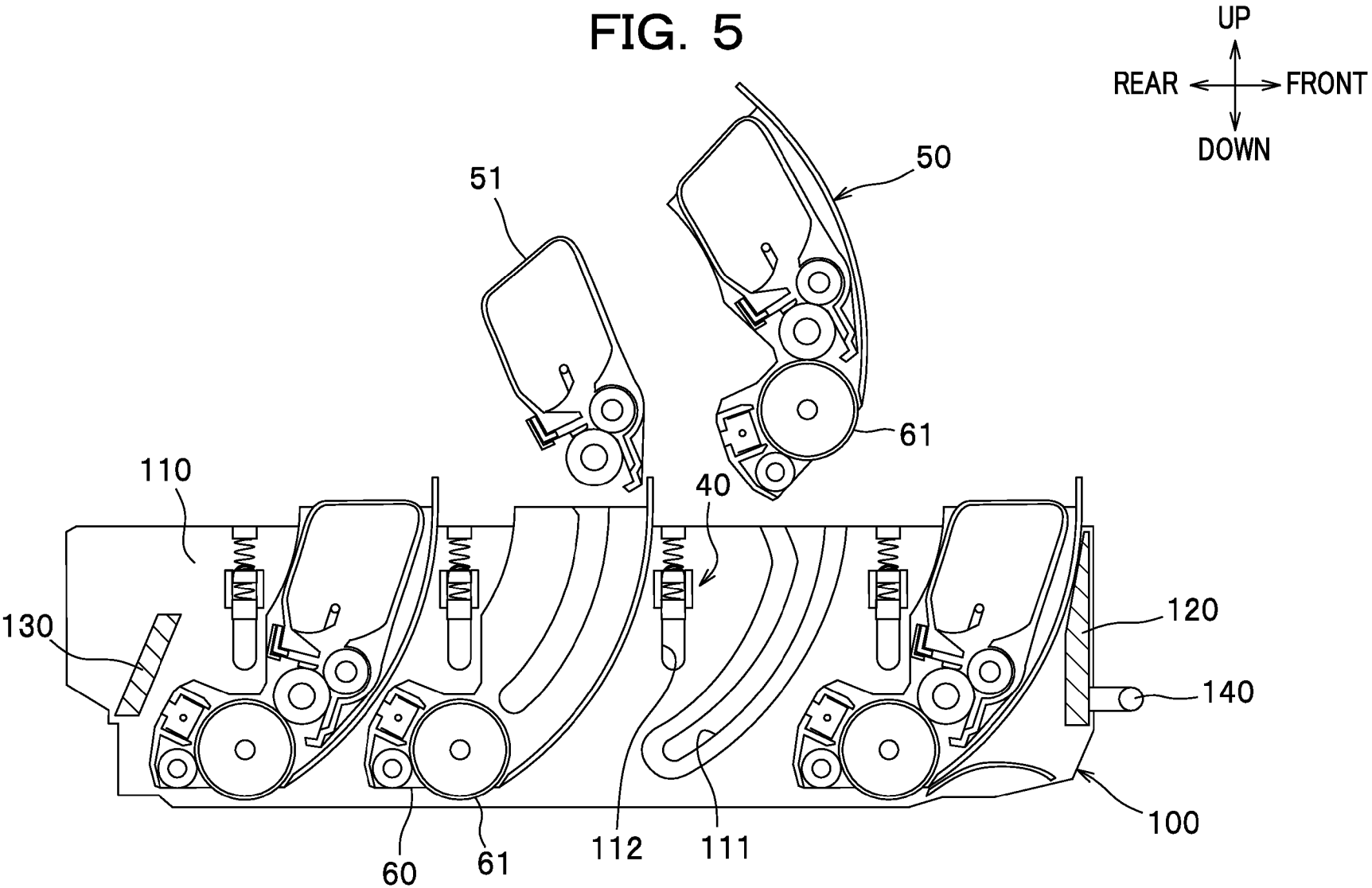
FIG. 5 is a sectional view showing the relationship between the drawer and process cartridges.

The drawer 100 has a pair of right and left side walls 110 disposed opposite to each other in the right-and-left direction (i.e., in the axial direction of the photoconductor drums 61), and configured to support the plurality of process cartridges 50 (plurality of photoconductor drums 61) and the plurality of LED arrays 40 between the side walls 110. As best seen in FIG. 5, the pair of side walls 110 are connected at their front end portions by a front wall 120 and at their rear portions by a rear wall 130. Further, a generally U-shaped handle portion 140 is provided on the front surface of the front wall 120 so that the user can grip the handle portion 140.

Arcuate grooves 111 are formed on the inner surface of each side wall 110, and each of the process cartridges 50 is guided along the corresponding groove 111 toward an exposure position at which each photoconductor drum 61 is exposed to light by the corresponding LED array 40. Accordingly, the process cartridge 50 is arcuately movable with respect to the drawer 100 and detachably mounted to the drawer 100.

Further, a plurality of oblong holes 112 are formed in each side wall 110; each oblong hole supports the LED array 40 while allowing an upward and downward movement of the LED array 40. The oblong hole 112 extends in the upward-and-downward direction, and for the purpose of guiding the LED array 40 between the exposure position and the retreating position the oblong hole 112 is engaged with an engageable portion 43A of the LED array 40 (see FIG. 6) to be described later.

Figure 6:
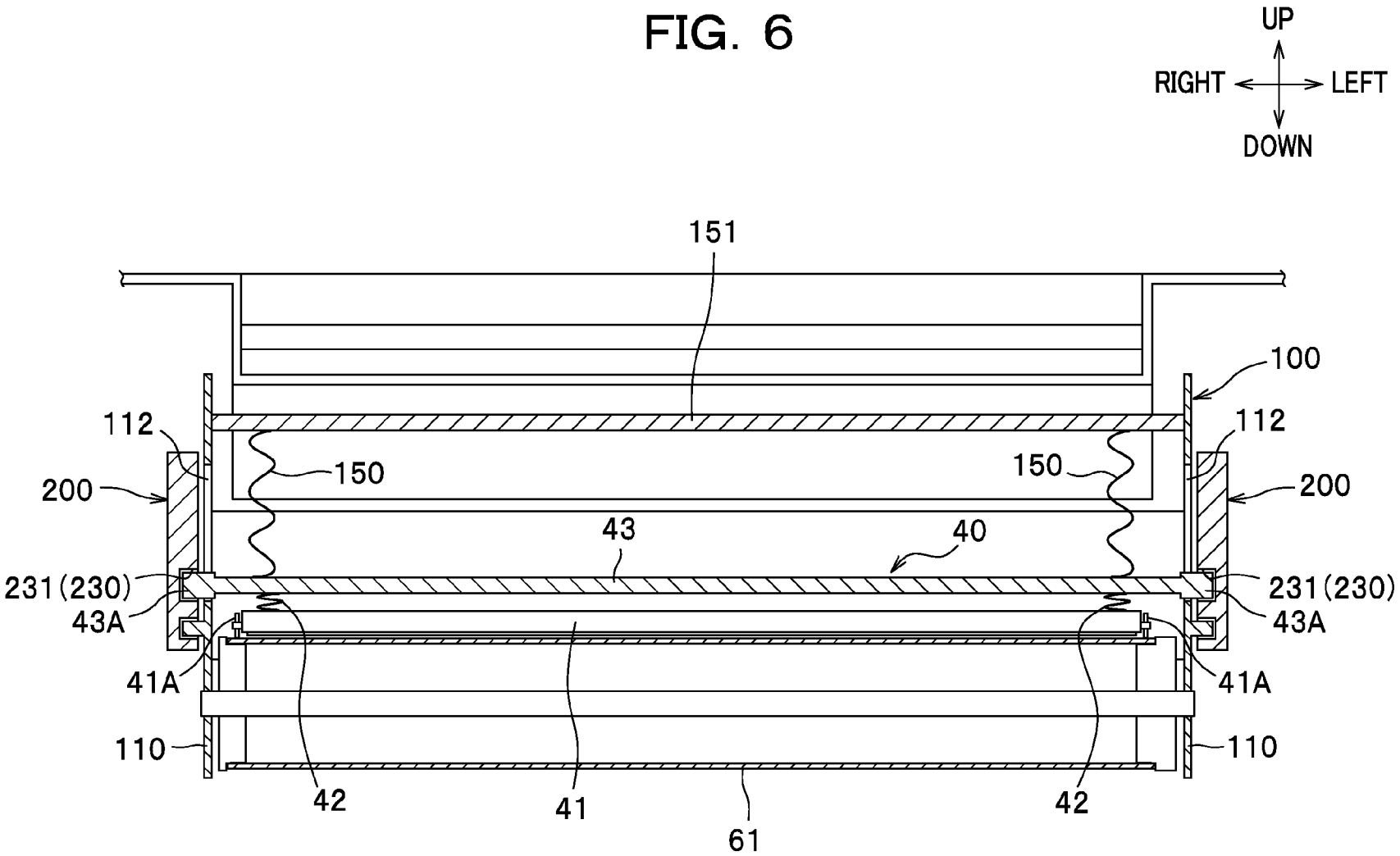
FIG. 6 is a sectional view of an LED array in the front-and-rear direction.

As best seen in FIG. 6, the LED array 40 includes an LED head 41 having a plurality of LEDs, a pair of coil springs 42 for urging the LED head 41 toward the photoconductor drum 61, and a support frame 43 for supporting the LED head 41 via the coil springs 42. The support frame 43 has an elongated shape extending in the right-and-left direction, and a pair of engageable portions 43A are provided at both end portions thereof. Each of the engageable portions 43A penetrates through the oblong hole 112 and extends outward in the right-and-left direction beyond the side wall 110.

The support frame 43 is supported by the drawer 100 via tension coil springs 150. To be more specific, the tension coil springs 150 are arranged between the support frame 43 and a supporting wall 151 which is fixed to and extending between the pair of side walls 110, and always urge the LED array 40 in a direction away from the photoconductor drum 61.

As seen in FIGS. 2-4 and 6, the pair of engageable portions 43A extending outward through the side walls 110 are brought into contact with the pair of guide members 200 provided outside the side walls 110, and pressed upward or downward by the guide members 200. The guide members 200 are provided in the main body casing 10 and configured to support the drawer 100 while allowing movement of the drawer 100 in the front-and-rear direction. In other words, the guide members 200 are relatively movable with respect to the drawer 100.

To be more specific, each guide member 200 includes a longitudinal plate-like body portion 210 extending in the front-and-rear direction, a drawer guide groove 220, and a guide groove 230.

The body portion 210 is arranged opposite to the side wall 110 of the drawer 100. The body portion 210 has two protruding pins 211 extending outward in the right-and-left direction; one protruding pin 211 is formed on a front lower portion of the body portion 210 and the other protruding pin 211 is formed on a rear lower portion of the body portion 210. These protruding pins 211 are supported by a pair of arcuate grooves 15 which are formed in a side frame 16 provided at each side of the main body casing 10. The pair of side frames 16 is an example of a pair of supporting walls.

With this configuration, the body portion 210 is movable between the position shown in FIG. 2 and the position shown in FIG. 3. To be more specific, the pair of body portions 210 are movably supported by the main body casing 10 such that the photoconductor drums 61 become movable between a contacting position in which the photoconductor drums 61 contact the conveyor belt 71 and a spaced-apart position in which the photoconductor drums 61 are away from the conveyor belt 71. Namely, according to this embodiment, the pins 211 formed on the pair of guide members 200 and two pairs of grooves 15 formed on the main body casing 10 constitute a separation mechanism configured to support the guide members 200 together with the drawer 100 such that the drawer 100 is movable at least in an upward-and-downward direction.

The drawer guide groove 220 is a groove for supporting the drawer 100 while allowing movement of the drawer 100 in the front-and-rear direction. The drawer guide groove 220 extends in the front-and-rear direction. To be more specific, the drawer guide groove 220 supports a pair of engagement pins 113A formed on a rear side of the side wall 110 of the drawer 100 and one engagement pin 113B formed on a front side of the side wall 110.

The drawer guide groove 220 has a pair of restriction surfaces 221, 222 for restricting movement of the pair of engagement pins 113A in the front-and-rear direction. With this configuration, a forward and rearward movement of the drawer 100 with respect to the guide members 200 can be restricted, and the drawer 100 can be positioned in the retracted position and in the pull-out position.

It is to be noted that the one engagement pin 113B formed on the front side of the side wall 110 of the drawer 100 has a length shorter than that of each of the engagement pins 113A so as to prevent the engagement pin 113B from being trapped by the restriction surface 221.

The guide groove 230 is a groove for guiding the engageable portion 43A such that the LED array 40 is guided from the retreating position to the exposure position when the drawer 100 is inserted into the main body casing 10. The rear end of the guide groove 230 is closed and the front end of the guide groove 230 opens outside. To be more specific, the guide groove 230 consists of an engagement portion 231 with which the engageable portion 43A is engaged when the LED array 40 is positioned in the exposure position, a guiding portion 232 by which the engageable portion 43A is allowed to move in the front-and-rear direction while the LED array 40 is in the retreating position, and a slanted portion 233 connecting the engagement portion 231 and the guiding portion 232.

The engagement portion 231 is shaped like a longitudinal groove extending in the front-and-rear direction, and an upward movement of the engageable portion 43A is restricted by an upper edge of the engagement portion 231. To be more specific, when the LED array 40 is positioned in the exposure position (i.e., position shown in FIG. 6 in which guide rollers 41A rotatably provided on the LED head 41 are brought into contact with the photoconductor drum 61), the LED head 41 is urged downward by the coil springs 42 and the engageable portion 43A is urged upward by the coil springs 42 and the tension coil springs 150. Therefore, since the engageable portion 43A contacts the upper edge of the engagement portion 231, the LED array 40 is positioned in the exposure position while being urged against the photoconductor drum 61 by a preferable urging force.

The guiding portion 232 is shaped like a longitudinal groove extending in the front-and-rear direction.

The slanted portion 233 is shaped like a longitudinal groove slanting downward as it goes rearward. With this shape of the slanted portion 233, as the drawer 100 is inserted into the guide members 200 (main body casing 10), the engageable portion 43A is pressed downward by the upper edge of the slanted portion 233 to thereby cause the LED array 40 to move downward into the exposure position. On the contrary, as the drawer 100 is pulled out from the guide members 200 (main body casing 10), the engageable portion 43A is pressed upward by the lower edge of the slanted portion 233 or pressed upward by the urging force of the tension coil springs 150 to thereby cause the LED array 40 to move into the retreating position.

The interlocking mechanism 300 causes the guide member 200 to actuate in synchronization with the opening and closing operation of the front cover 12, so that when the front cover 12 is moved from the closed position to the opened position, the guide member 200 (photoconductor drums 61) is moved from the contacting position to the spaced-apart position. To be more specific, the interlocking mechanism 300 includes a sector member 310 fixed to the front cover 12, and a link member 320 connecting the guide member 200 and the sector member 310.

The sector member 310 has a sector shape whose center of curvature coincides with the axis of rotation 12A of the front cover 12. The sector member 310 is fixed to a lower end portion of the front cover 12 on each side (i.e., right side and left side) thereof.

The link member 320 has one end which is rotatably connected to the protruding pin 211 positioned at the front side of the guide member 200 and the other end which is rotatably connected to the sector member 310.

Accordingly, when the front cover 12 is opened, the pair of guide members 200 are pulled forward by the front cover 12 via the link members 320 and the sector members 310, so that the guide members 200 are moved diagonally upward and frontward along the arcuate grooves 15. When the front cover 12 is closed, the pair of guide members 200 are pressed rearward by the front cover 12 via the link members 320 and the sector members 310, so that the guide members 200 are moved diagonally downward and rearward along the arcuate grooves 15.

A rear portion of the drawer 100, a rear portion of the guide member 200, and a rear portion of a flat cable 400 to be described later extend into the space located at each side (i.e., right side and left side) of the sheet output tray portion 13. To be more specific, when the front cover 12 is closed and the color printer 1 is placed in condition ready for printing, the rear portion of the drawer 100, the rear portion of the guide member 200, and the rear portion of the flat cable 400 overlap with the sheet output tray portion 13 as viewed from side.

Accordingly, the upper wall 14 of the main body casing 10 can be lowered without changing the depth of the sheet output tray portion 13, which leads to miniaturization of the size (height) of the main body casing 10 in the upward-and-downward direction. Further, since part of the drawer 100 is arranged in the space located at each side of the sheet output tray portion 13, an upper front portion of the drawer 100 (upper portions of the process cartridges 50), upper front portions of the pair of guide members 200, and a front portion of the flat cable 400 are arranged in a space below the second wall 132 of the sheet output tray portion 13 and the upper wall 14 of the main body casing 10. By this arrangement, it is possible to effectively utilize the space below the second wall 132 of the sheet output tray portion 13 and the upper wall 14 of the main body casing 10.

As seen in FIG. 4, a main body circuit board 600 is provided in the main body casing 10. The main body circuit board 600 is connected to the plurality of LED arrays 40 via the flat cable 400.

The main body circuit board 600 is configured to receive printing instructions outputted from a device such as a personal computer and to execute a control for converting image date contained in the printing instructions into driving signals to drive the LEDs. The main body circuit board 600 is arranged in the main body casing 10 at a position above the drawer 100. Accordingly, interference between the flat cable 400 and the conveyor belt 71 can be avoided.

To be more specific, the main body circuit board 600 is arranged in the main body casing 10 in a space above the lower edge of the sheet output tray portion 13 (second wall 132). Accordingly, possible wasted space created at the upper part of the main body casing 10 by the provision of the recess-shaped sheet output tray portion 13 can be effectively utilized as an installation space for the main body circuit board 600 and the flat cable 400.

Further, the main body circuit board 600 is mounted on the underside of a metal plate 17; the metal plate 17 connects upper end portions of the right and left side frames 16. Therefore, the right and left side frames 16 are reinforced by the metal plate 17, and noise (electromagnetic wave) coming from outside and applied to the main body circuit board 600 can be cut off by the metal plate 17.

The flat cable 400 extends between the main body circuit board 600 and the drawer 100, and is arranged such that the width direction thereof conforms to the axial direction of the photoconductor drums 61 and the flat surface thereof confronts the upward-and-downward direction. The flat cable 400 is folded into a U-shape, as viewed from side, with its open end facing toward the front side of the color printer 1 and with the two flat surfaces facing to each other. When the drawer 100 is moved in the front-and-rear direction, an end of the flat cable 400 is moved to fold the flat cable 400 into the U-shape or to unfold the U-shaped folded flat cable. The movement of the drawer 100 is allowed because the bottom part of the U-shape changes its position.

The flat cable 400 is folded back and forth at its portion located closer to the LED array 40 such that a corrugated portion is formed within the drawer 100. Accordingly, the movement of the LED array 40 in the upward-and-downward direction is allowed by the corrugated portion 411 of the flat cable 400.

Figure 7:
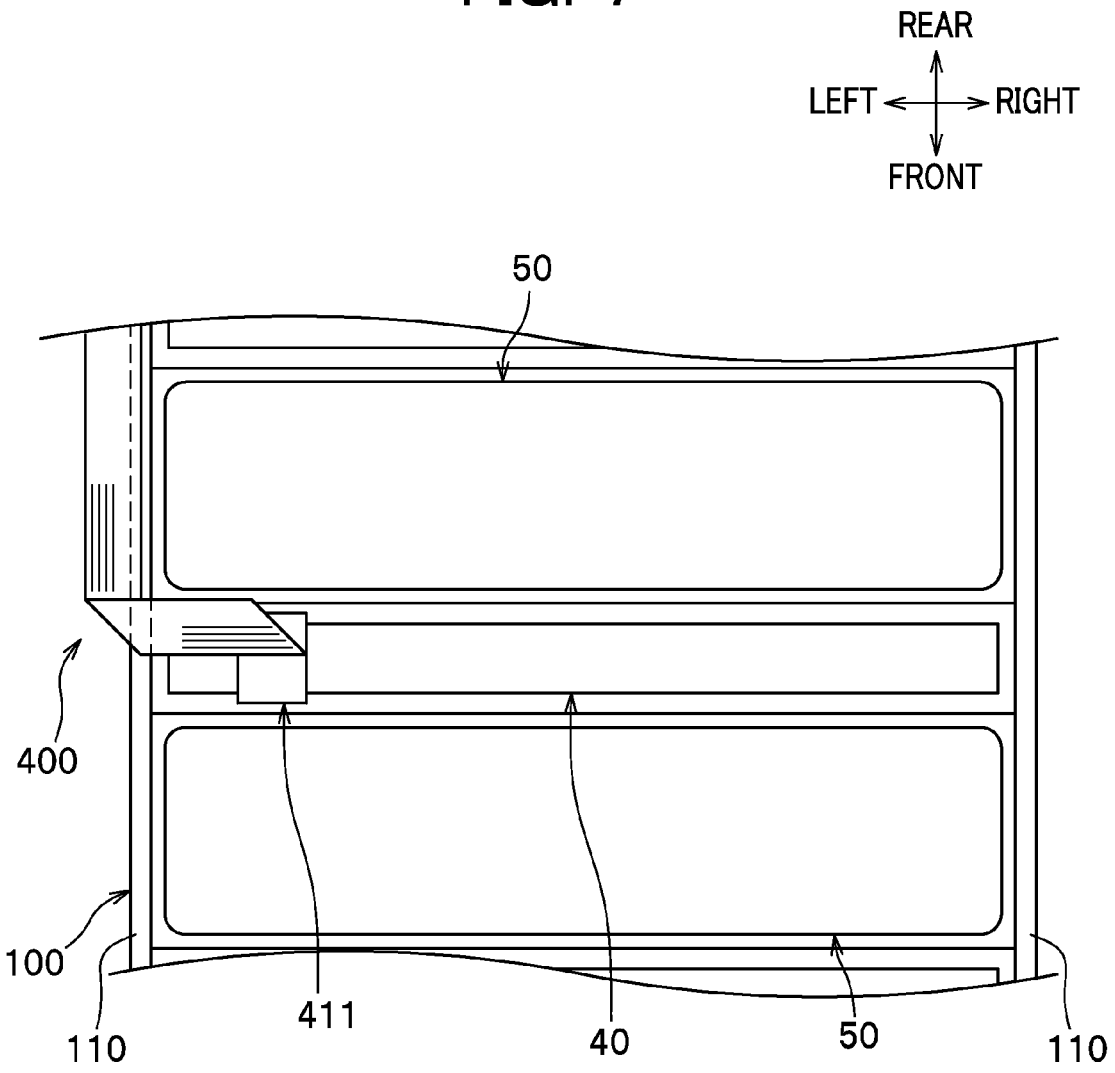
FIG. 7 is a top view schematically showing the relationship between a flat cable and the process cartridges.
Figure 8:
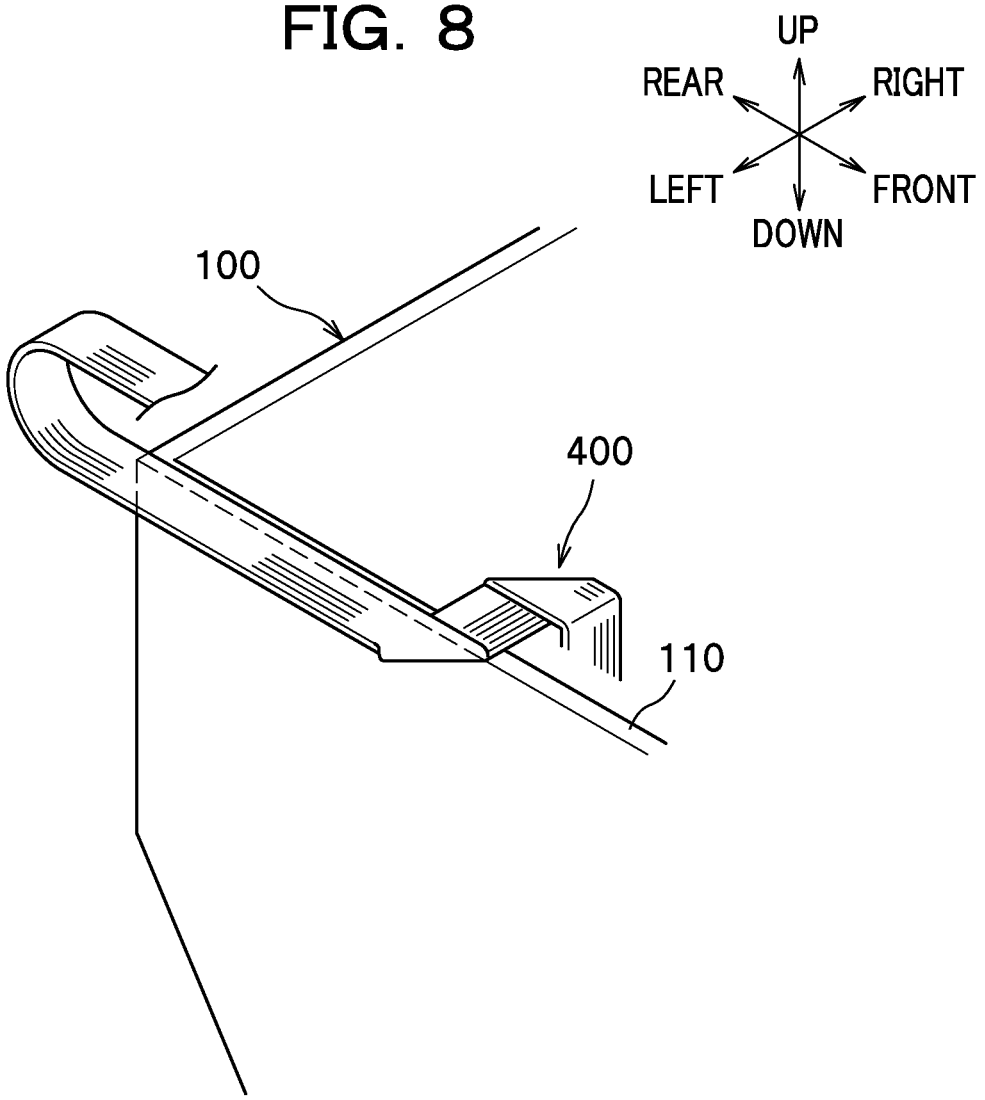
FIG. 8 is a perspective view schematically showing the flat cable.

As best seen in FIGS. 7 and 8, the flat cable 400 extends upward a short distance from the corrugated portion 411, and is folded in the right-and-left direction such that the cable 410 extends outward beyond the process cartridge 50. Thereafter the flat cable 400 is folded rearward to make a 90-degree turn such that the cable 410 extends rearward, and then folded upward into a U-shape to make a 180-degree turn such that the cable 410 extends toward the main body circuit board 600 positioned above the drawer 100. This makes it possible to prevent the flat cable 400 from being an obstacle when the process cartridge 50 is attached to or removed from the drawer 100 from above.

To be more specific, the flat cable 400 extends upward from the corrugated portion 411 facing perpendicularly to the front-and-rear direction, and is folded rearward at right angles at a position higher than the side wall 110 of the drawer 100 and then folded outward in the right-and-left direction such that the cable 400 extends outward beyond the side wall 110 of the drawer 100. Thereafter, the flat cable 400 is folded rearward to make a 90-degree turn such that the cable 400 extends rearward, and then folded into a U-shape and connected to the main body circuit board 600.

Further, the flat cable 400 is made of an electromagnetic interference shielding material. Accordingly, noise coming from outside and applied to the flat cable 400 can be cut off.

With the configuration of the color printer 1 according to this embodiment, the following advantageous effects can be achieved.

Since the main body circuit board 600 is arranged above the drawer 100, the flat cable 400 connecting the LED arrays 40 disposed in the drawer 100 and the main body circuit board 400 is spaced apart from the conveyor belt 71 disposed below the drawer 100. Accordingly, interference between the conveyor belt 71 and the flat cable 400 can be avoided.

Since the main body circuit board 600 is arranged in the main body casing 10 in a space above the lower edge of the sheet output tray portion 13, possible wasted space created at the upper part of the main body casing 10 by the provision of the recess-shaped sheet output tray portion 13 can be effectively utilized.

Since the flat cable 400 is folded within the drawer 100 to form a corrugated portion 411, the movement of the LED arrays 40 is allowed by the corrugated portion 411 and the flat cable 400 can be compactly located in the drawer 100. Further, since the corrugated portion 411 is arranged in the drawer 100, interference of the corrugated portion 411 with other parts can be avoided during the movement of the drawer 100.

Since the LED arrays 40 are located in the drawer 100 when they are in the exposure position and in the retreating position, interference of the LED arrays 40 with other parts can be avoided and the drawer 100 can prevent the user from unintentionally contacting the LED arrays 40.

Since the flat cable 400 is folded in the right-and-left direction such that the cable 400 extends outward from the corrugated portion 411 beyond the process cartridge 50 and then folded such that the cable 400 extends toward the main body circuit board 600, it is possible to prevent the flat cable 400 from being an obstacle when the process cartridge 50 is attached to or removed from the drawer 100.

Since the main body circuit board 600 is mounted on the metal plate 17 connecting the upper end portions of the right and left side frames 16, the right and left side frames 16 are reinforced by the metal plate 17 and noise coming from outside and applied to the main body circuit board 600 can be cut off by the metal plate 17.

Since the flat cable 400 is made of an electromagnetic interference shielding material, noise coming from outside and applied to the flat cable 400 can be cut off.

Since the movement of the guide members 200 is interlocked with the front cover 12, the attachment/removal operation of the drawer 100 can be eased, as compared with a structure in which the guide members 200 are manually moved in the upward-and-downward direction after the front cover 12 is opened.

Although an illustrative embodiment of the present invention has been described in detail, the present invention is not limited to this specific embodiment. It is to be understood that various changes and modifications may be made without departing from the scope of the appended claims.

In the above embodiment, the LED arrays 40 are used as an example of exposure members. However, the present invention is not limited to this specific configuration. For example, a number of light emitting elements such as EL (electroluminescence) elements and phosphors may be arranged such that they are made to selectively emit light in accordance the image data. As an alternative, a number of optical shutters comprising liquid crystal elements or PLZT elements may be provided with respect to one optical source, and the time for opening and closing each of the optical shutters may be selectively controlled in accordance with the image data to thereby control the light from the optical source.

In the above embodiment, four pairs of oblong holes 112 formed in the pair of side walls 110 are employed as stopper portions for positioning the exposure members in the retreating position. However, the present invention is not limited to this specific configuration. For example, the exposure members may be engaged with parts other than the side walls.

In the above embodiment, the conveyor belt 71 for conveying a sheet P between the surface thereof and the photoconductor drums 61 is used as an example of a belt. However, the present invention is not limited to this specific configuration, and an intermediate transfer belt on which toner carried on the photoconductor drums is transferred may be used, instead.

In the above embodiment, the pins 211 formed on the pair of guide members 200 and the two pairs of grooves 15 formed on the main body casing 10 constitute a separation mechanism. However, the present invention is not limited to this specific configuration. For example, a combination of the guide members and the link mechanism may constitute the separation mechanism. Further, a geared mechanism may be used to constitute an interlocking mechanism. It is to be noted that the separation mechanism is not an indispensable part of the color printer 1 and may be omitted. In such structure of the color printer, when the drawer 100 is in the retracted position from which the drawer 100 is pulled rectilinearly toward the pull-out position, the photoconductor drums 61 are positioned in the contacting position.

In the above embodiment, the color printer 1 is used as an example of an image forming apparatus. However, the present invention is applicable to other image forming apparatuses such as a copying machine and a multifunction printer.

What is claimed is:

1. An image forming apparatus comprising:

a plurality of photoconductor drums;

a drum supporting member having a pair of side walls disposed opposite to each other in an axial direction of the photoconductor drums and configured to support the plurality of photoconductor drums between the side walls;

a plurality of exposure members supported by the drum supporting member, each exposure member configured to expose a corresponding photoconductor drum to light to form an electrostatic latent image on the photoconductor drum;

a belt disposed below and opposite to the photoconductor drums;

a pair of guide members configured to support the drum supporting member while allowing rectilinear movement of the drum supporting member between a retracted position in which the drum supporting member is received in a main body of the image forming apparatus and a pull-out position to which the drum supporting member is moved from the retracted position and pulled out from the main body through an opening formed in the main body;

a main body circuit board provided in the main body and connected to the plurality of exposure members via a cable; and a sheet output tray portion configured to hold a recording sheet on which an image has been formed, wherein the main body circuit board is arranged above the drum supporting member, and wherein a part of the cable is located in a space formed outside the sheet output tray portion in the axial direction, when the drum supporting member is in the retracted position.

2. The image forming apparatus according to claim 1, wherein the sheet output tray portion is shaped as a recess in an upper wall of the main body and the main body circuit board is arranged in the main body in a space above a lower edge of the sheet output tray portion.

3. The image forming apparatus according to claim 1, wherein the cable is a flat cable and arranged such that a width of the flat cable extends in the axial direction.

4. The image forming apparatus according to claim 1, further comprising a pair of supporting walls for supporting the pair of guide members, and a metal plate connecting upper end portions of the pair of supporting walls, and wherein the main body circuit board is mounted on the metal plate.

5. The image forming apparatus according to claim 1, wherein the cable is made of an electromagnetic interference shielding material.

6. The image forming apparatus according to claim 1, further comprising a separation mechanism configured to support the guide members together with the drum supporting member such that the photoconductor drums are movable in an upward-and-downward direction between a contacting position in which the photoconductor drums contact the belt and a spaced-apart position in which the photoconductor drums are away from the belt, and wherein the guide members support the drum supporting member while allowing movement of the drum supporting member in a horizontal direction.

7. The image forming apparatus according to claim 6, wherein the main body has a cover movable between a closed position in which the opening is closed by the cover and an opened position in which the opening is left open, and wherein the image forming apparatus further comprises an interlocking mechanism configured to cause the cover and the separation mechanism to move in an interlocking manner such that when the cover is moved from the closed position to the opened position, the photoconductor drums are moved from the contacting position to the spaced-apart position.

8. The image forming apparatus according to claim 1, further comprising a plurality of developer receptacles each configured to store developer, a plurality of development rollers configured to supply developer stored in the developer receptacles to the photoconductor drums, and a plurality of process cartridges each including the photoconductor drum, and wherein each of the process cartridges is arcuately movable with respect to the drum supporting member and detachable from the drum supporting member.

9. An image forming apparatus comprising:

a plurality of photoconductor drums;

a drum supporting member having a pair of side walls disposed opposite to each other in an axial direction of the photoconductor drums and configured to support the plurality of photoconductor drums between the side walls;

a plurality of exposure members supported by the drum supporting member, each exposure member configured to expose a corresponding photoconductor drum to light to form an electrostatic latent image on the photoconductor drum;

a belt disposed below and opposite to the photoconductor drums;

a pair of guide members configured to support the drum supporting member while allowing rectilinear movement of the drum supporting member between a retracted position in which the drum supporting member is received in a main body of the image forming apparatus and a pull-out position to which the drum supporting member is moved from the retracted position and pulled out from the main body through an opening formed in the main body; and a main body circuit board provided in the main body and connected to the plurality of exposure members via a cable, wherein the main body circuit board is arranged above the drum supporting member, and wherein the plurality of exposure members are supported by the drum supporting member so as to be movable between an exposure position in which the exposure members are positioned adjacent to the photoconductor drums and a retreating position in which the exposure members are away from the photoconductor drums and engaged with stopper portions, and the exposure members are located in the drum supporting member when they are in the exposure position and in the retreating position.

10. The image forming apparatus according to claim 9, further comprising a plurality of process cartridges each having the photoconductor drum and configured to be detachably mounted to the drum supporting member from above, wherein the cable is folded within the drum supporting member to form a folded portion, and wherein the cable is folded in the axial direction of the photoconductor drum such that the cable extends outward from the folded portion beyond the process cartridge, and then folded such that the cable extends toward the main body circuit board.

11. The image forming apparatus according to claim 9, further comprising a sheet output tray portion shaped as a recess in an upper wall of the main body and configured to hold a recording sheet on which an image has been formed, wherein the main body circuit board is arranged in the main body in a space above a lower edge of the sheet output tray portion.

12. The image forming apparatus according to claim 11, wherein a part of the cable is located in a space formed outside the sheet output tray portion in the axial direction, when the drum supporting member is in the retracted position.

13. The image forming apparatus according to claim 9, wherein the cable is a flat cable and arranged such that a width of the flat cable extends in the axial direction.

14. The image forming apparatus according to claim 9, further comprising a pair of supporting walls for supporting the pair of guide members, and a metal plate connecting upper end portions of the pair of supporting walls, and wherein the main body circuit board is mounted on the metal plate.

15. The image forming apparatus according to claim 9, wherein the cable is made of an electromagnetic interference shielding material.

16. The image forming apparatus according to claim 9, further comprising a separation mechanism configured to support the guide members together with the drum supporting member such that the photoconductor drums are movable in an upward-and-downward direction between a contacting position in which the photoconductor drums contact the belt and a spaced-apart position in which the photoconductor drums are away from the belt, and wherein the guide members support the drum supporting member while allowing movement of the drum supporting member in a horizontal direction.

17. The image forming apparatus according to claim 16, wherein the main body has a cover movable between a closed position in which the opening is closed by the cover and an opened position in which the opening is left open, and wherein the image forming apparatus further comprises an interlocking mechanism configured to cause the cover and the separation mechanism to move in an interlocking manner such that when the cover is moved from the closed position to the opened position, the photoconductor drums are moved from the contacting position to the spaced-apart position.

18. The image forming apparatus according to claim 9, further comprising a plurality of developer receptacles each configured to store developer, a plurality of development rollers configured to supply developer stored in the developer receptacles to the photoconductor drums, and a plurality of process cartridges each including the photoconductor drum, and wherein each of the process cartridges is arcuately movable with respect to the drum supporting member and detachable from the drum supporting member.

* * * * *